US010744666B1

(12) United States Patent
Shih

(10) Patent No.: US 10,744,666 B1
(45) Date of Patent: Aug. 18, 2020

(54) PAD SUPPORTING FRAME

(71) Applicant: SUN SAME ENTERPRISES CO., LTD., Tainan (TW)

(72) Inventor: Wen Jer Shih, Tainan (TW)

(73) Assignee: SUN SAME ENTERPRISE CO., LTD., Tainan (TW)

( * ) Notice: Subject to any disclaimer, the term of this patent is extended or adjusted under 35 U.S.C. 154(b) by 0 days.

(21) Appl. No.: 16/400,416

(22) Filed: May 1, 2019

(30) Foreign Application Priority Data

Jan. 24, 2019 (TW) ..... 108201120 A

(51) Int. Cl.
*B26D 7/20* (2006.01)
*B26D 7/01* (2006.01)
*B41K 1/00* (2006.01)

(52) U.S. Cl.
CPC ..... *B26D 7/01* (2013.01); *B26D 7/20* (2013.01); *B41K 1/00* (2013.01)

(58) Field of Classification Search
CPC .. B26D 7/20; B25B 11/00; B25H 1/02; B25H 1/04; B41K 1/00; B41K 3/02
See application file for complete search history.

(56) References Cited

U.S. PATENT DOCUMENTS 3,955,681 A * 5/1976 DeZinno ..... A47B 87/0223 211/85.1
4,838,176 A * 6/1989 Bowser, Sr. ..... B65D 19/0018 108/53.3
6,409,138 B1 * 6/2002 Baccini ..... H05K 3/0097 108/53.1
10,045,629 B2 * 8/2018 Urban ..... A47C 19/20
10,342,387 B1 * 7/2019 Hugo ..... A47J 47/005

* cited by examiner

*Primary Examiner* — Stephen Choi
(74) *Attorney, Agent, or Firm* — R. Lynette Wylie; Apex Juris, pllc.

(57) ABSTRACT

A pad supporting frame has a carrier board and a supporting structure. The supporting structure is detachably disposed on the carrier board. The supporting structure is detachably disposed on the bottom surface of the carrier board. In delivery, the carrier board and the supporting structure can be stacked separately for increasing the utilization of the delivery space. Molds of the carrier board and the supporting structure can be made separately for decreasing the volumes of the molds. For cutting a pad disposed on the carrier board, the carrier board can be directly disposed on the tabletop. The carrier board will not be deformed and the cutting quality of the pad is improved.

7 Claims, 15 Drawing Sheets

PAD SUPPORTING FRAME

This application claims the benefit of Taiwan patent application No. 108201120, filed on Jan. 24, 2019.

BACKGROUND OF THE INVENTION

1. Field of the Invention

The present invention relates to a pad supporting frame, and more particularly to a pad supporting frame that is applied to carry a pad and is detachable for improving a cutting quality of the pad.

2. Description of Related Art

With reference to FIGS. 11 and 12, a conventional pad supporting frame is an integrated component and has a carrier board 90 and four supporting feet 91. The carrier board 90 has a top surface, a bottom surface, multiple bars 92, and four retaining holes 93. The bars 92 protrude out of the top surface of the carrier board 90 at spaced intervals. The four retaining holes 93 are formed on the top surface of the carrier board 90 adjacent to four corners of the carrier board 90, respectively. The four supporting feet 91 protrude out of the bottom surface of the carrier board 90, and are respectively located below the four retaining holes 93. Each supporting foot 91 has a first stepped portion 94, a second stepped portion 95, and an abutting surface 96. The first stepped portion 94 is formed on and protrudes out of the bottom surface of the carrier board 90. The second stepped portion 95 is formed on an end surface of the first stepped portion 94. An outer diameter of the second stepped portion 95 is smaller than an outer diameter of the first stepped portion 94. The abutting surface 96 is formed on the end surface of the first stepped portion 94 around the second stepped portion 95.

With reference to FIGS. 12 and 13, for delivery, multiple conventional pad supporting frames are stacked with each other. The supporting feet 91 of an upper pad supporting frame are respectively inserted into the retaining holes 93 of a lower pad supporting frame. The abutting surface 96 of each one of the four supporting feet 91 of the upper pad supporting frame abuts against the top surface of the carrier board 90 of the lower pad supporting frame. However, the conventional pad supporting frame is an integrated component. A total height of the conventional pad supporting frame is large because the four supporting feet 91 cannot be detached from the carrier board 90. Delivery volume of the conventional pad supporting frame cannot be decreased efficiently. Furthermore, a mold for manufacturing the conventional pad supporting frame is also large.

With reference to FIG. 14, the conventional pad supporting frame is applied to carry a pad 97. The pad 97 is an integrated member. The pad 97 has a top surface, a bottom surface, multiple retaining grooves, and multiple printing protrusions 98. The retaining grooves are formed on the bottom surface of the pad 97 at spaced intervals. The printing protrusions 98 are formed on the top surface of the pad 97. The pad 97 is disposed on the conventional pad supporting frame. The bars 92 of the carrier board 90 are respectively inserted into the retaining grooves of the pad 97 for positioning the pad 97. The conventional pad supporting frame can be disposed on a tabletop 80 for preparing the cutting of the pad 97. However, the four supporting feet 91 of the conventional pad supporting frame directly contact the tabletop 80. The bottom surface of the carrier board 90 faces the tabletop 80 without direct contact. When the cutting tool 81 cuts the pad 97, the cutting tool 81 is pressed downwardly and generates a cutting force to apply on the carrier board 90. The carrier board 90 is deformed easily, which would influence the cutting quality of the pad 97.

In addition, with reference to FIG. 15, after the cutting operation of the pad 97 is finished, multiple conventional pad supporting frames can be stacked. Because the height of each one of first stepped portions 94 is smaller than the height of a cover 99, the cover 99 only covers a topmost pad supporting frame for only protecting the pad 97 on the topmost pad supporting frame.

Furthermore, when the cover 99 covers the topmost pad supporting frame, two side plate portions of the cover 99 respectively cover two opposite side walls of the carrier board 90 of the topmost pad supporting frame. The two opposite side walls of the carrier board 90 of the topmost pad supporting frame are covered by the cover 99 and are hard to be grabbed by users for opening the cover 99 covering the carrier board 90.

To overcome the shortcomings, the present invention provides a pad supporting frame to mitigate or obviate the aforementioned problems.

SUMMARY OF THE INVENTION

The objective of the invention is to provide a pad supporting frame that can solve the shortcoming that the delivery volume and the mold of the conventional pad supporting frame are large, the carrier board of the conventional pad supporting frame is easily deformed, and the cutting quality of the pad is decreased.

The pad supporting frame has a carrier board and a supporting structure. The carrier board has a top surface, a bottom surface, multiple bars, and multiple connecting holes. The bars are formed on and protrude out of the top surface of the carrier board at spaced intervals. The connecting holes are formed through the top surface and the bottom surface of the carrier board.

The supporting structure is detachably disposed on the carrier board, is located on the bottom surface of the carrier board, and has multiple connecting protrusions, multiple retaining holes, and multiple retaining protrusions. The connecting protrusions are respectively inserted into the connecting holes. The retaining holes are formed on top surfaces of the connecting protrusions respectively. The retaining protrusions are formed on bottom surfaces of the connecting protrusions, respectively. An outer diameter of each one of the retaining holes is smaller than an outer diameter of a corresponding one of the connecting protrusions.

The supporting structure is detachably disposed on the bottom surface of the carrier board. The supporting structure and the carrier board are independent components. Molds of the carrier board and the supporting structure are made separately for decreasing the volumes of the molds. For delivery, the supporting structure is detached from the carrier board in each pad supporting frame. The detached supporting structures and the carrier boards can be stacked separately for decreasing the delivery volume of the pad supporting frame. A pad can be disposed on the carrier board of the pad supporting frame. For cutting, the supporting structure is detached from the carrier board. The carrier board is directly disposed on a tabletop. The bottom surface of the carrier board completely contacts the tabletop. The carrier board supported by the tabletop cannot be deformed for improving the cutting quality of the pad.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
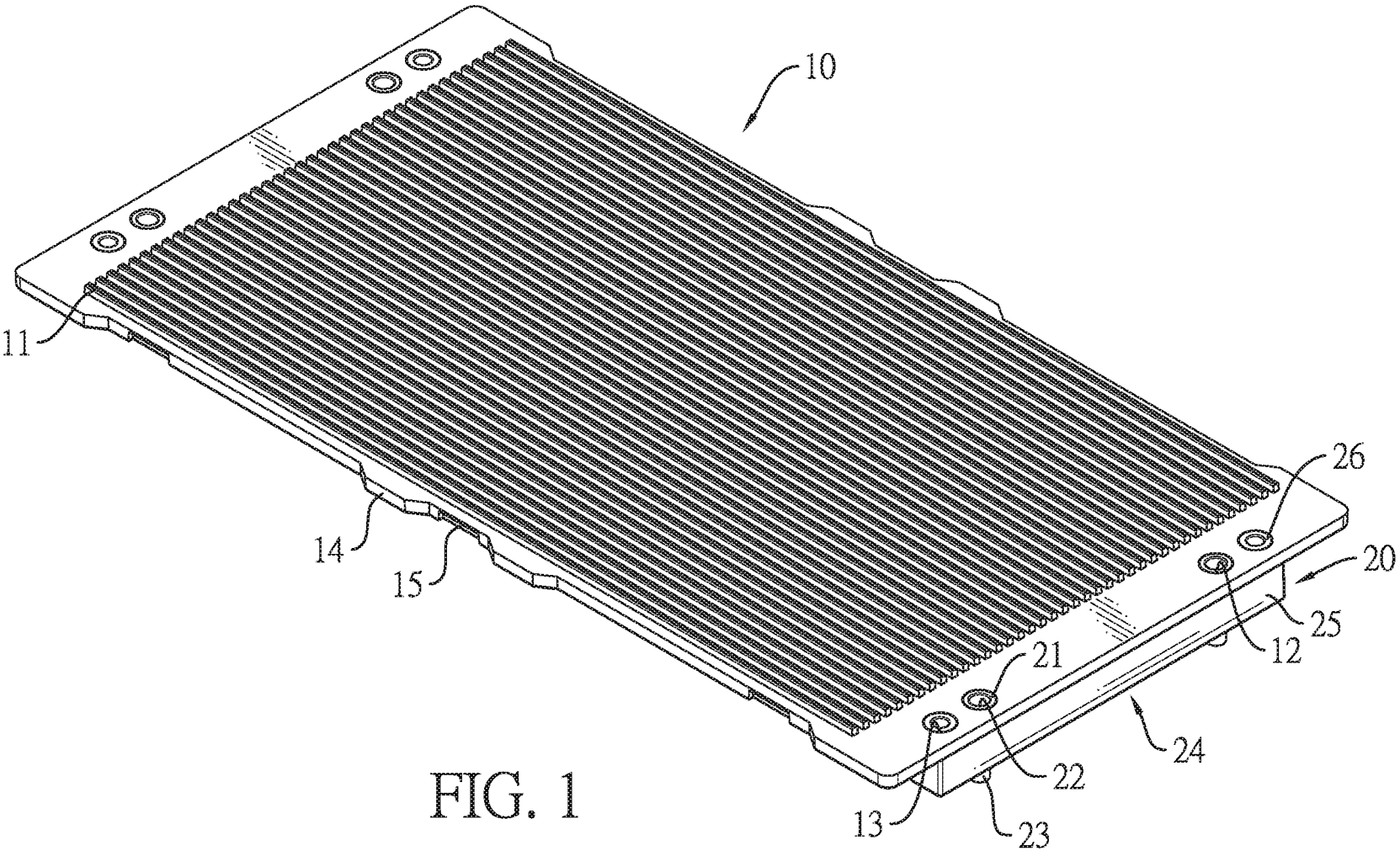
FIG. 1 is a top perspective view of a first embodiment of a pad supporting frame in accordance with the present invention.
Figure 2:
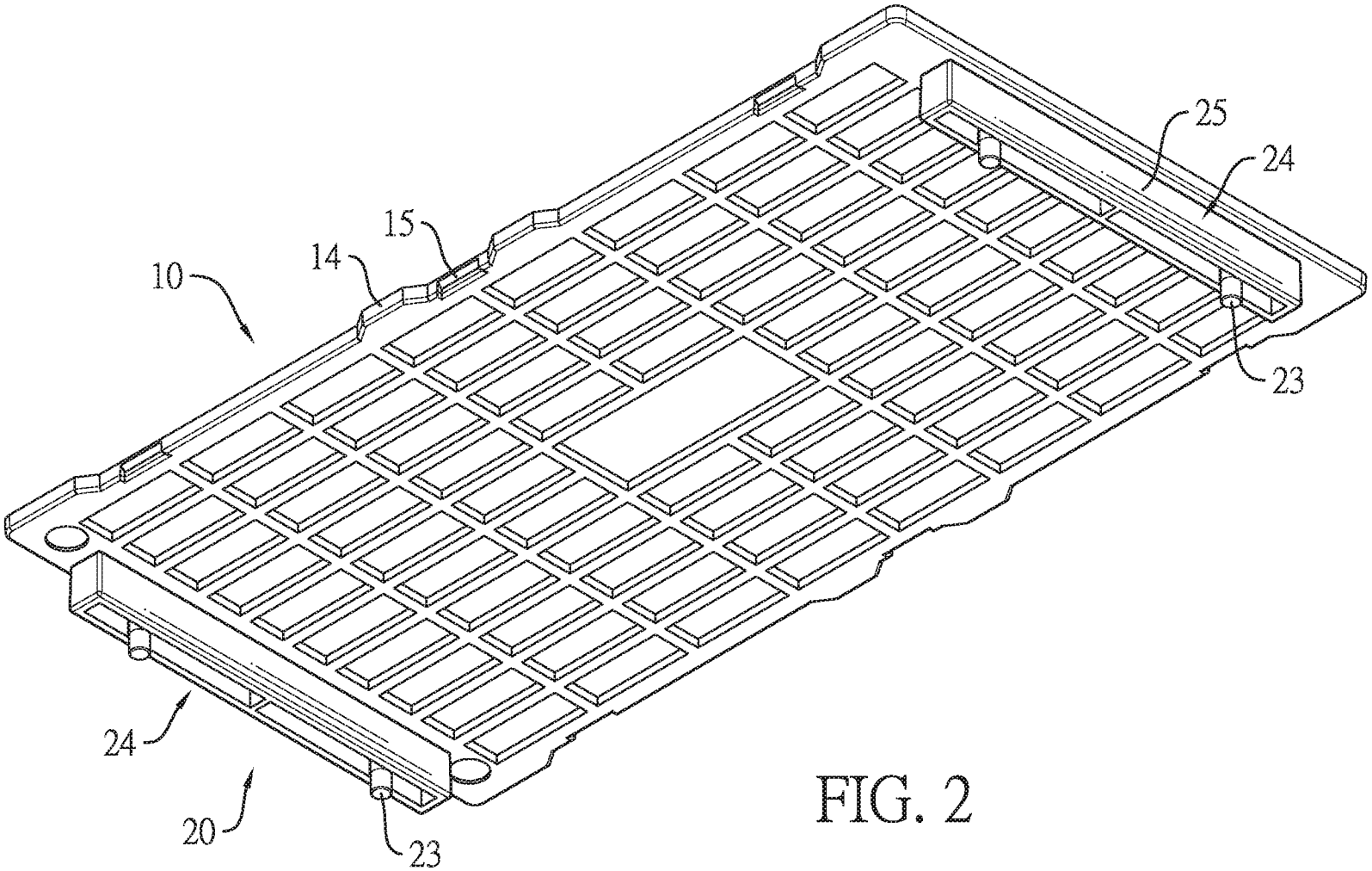
FIG. 2 is a bottom perspective view of the pad supporting frame in FIG. 1.
Figure 3:
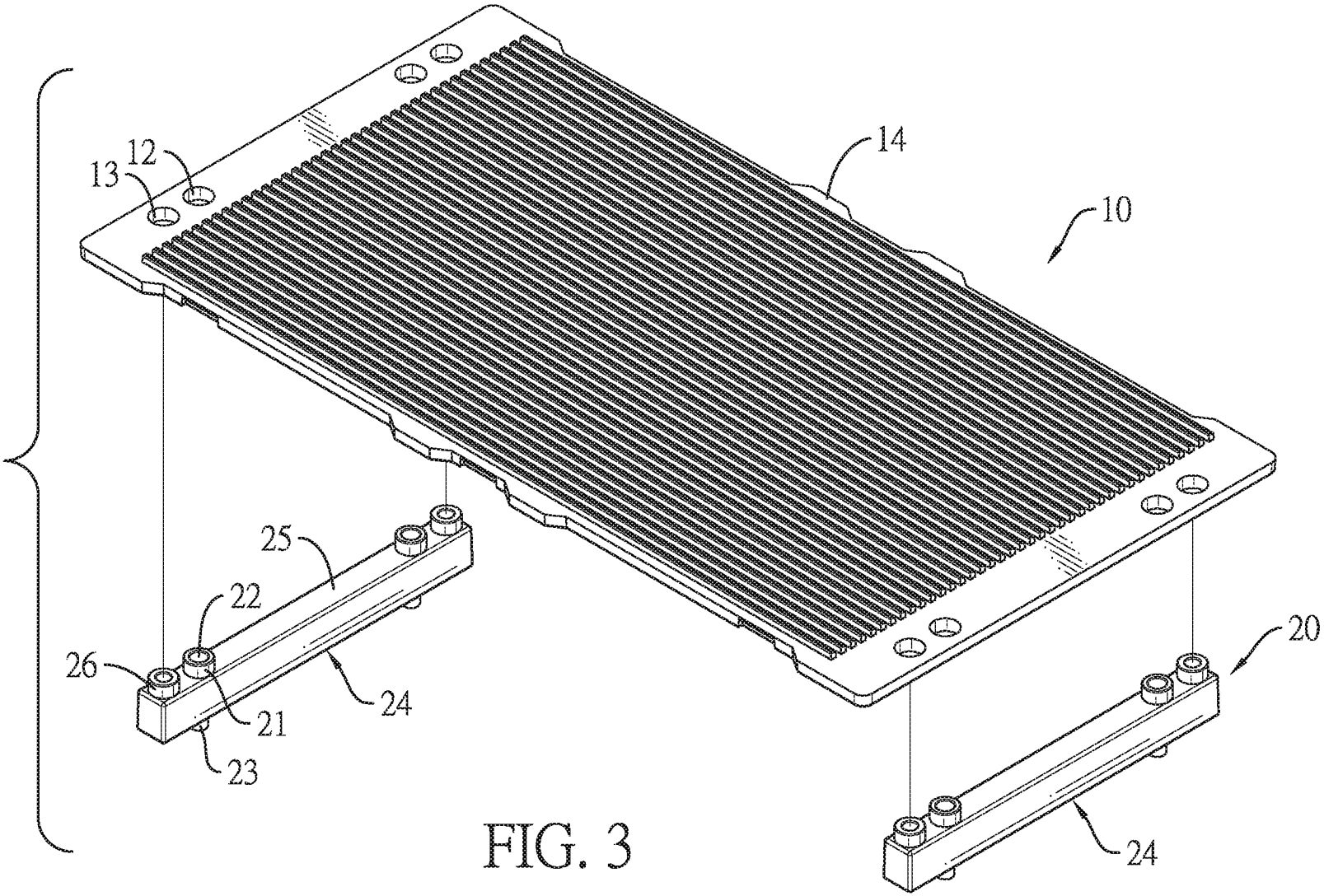
FIG. 3 is an exploded perspective view of the pad supporting frame in FIG. 1.

With reference to FIGS. 1 and 3, a pad supporting frame in accordance with the present invention comprises a carrier board 10 and a supporting structure 20.

The carrier board 10 has a top surface, a bottom surface, multiple bars 11, and multiple connecting holes 12. The bars 11 are formed on and protrude out of the top surface of the carrier board 10 at spaced intervals. The connecting holes 12 are formed through the top surface and the bottom surface of the carrier board 10.

The supporting structure 20 is detachably disposed on the carrier board 10, is located on the bottom surface of the carrier board 10, and has multiple connecting protrusions 21, multiple retaining holes 22, and multiple retaining protrusions 23. The connecting protrusions 21 are respectively inserted into the connecting holes 12. The retaining holes 22 are formed on top surfaces of the connecting protrusions 21, respectively. The retaining protrusions 23 are formed on bottom surfaces of the connecting protrusions 21, respectively. An outer diameter of each one of the retaining holes 22 is smaller than an outer diameter of a corresponding one of the connecting protrusions 21.

The connecting protrusions 21 are disposed adjacent to two opposite side edges of the carrier board 10. The supporting structure 20 has two supporting feet 24. The two supporting feet 24 are detachably disposed on the bottom surface of the carrier board 10 at a spaced interval, and are respectively located adjacent to the two opposite side edges of the carrier board 10. Each one of the two supporting feet 24 has a body 25. The connecting protrusions 21 are respectively disposed on the bodies 25 of the two supporting feet 24.

The two supporting feet 24 are elongate components. The amount of the connecting protrusions 21 is four. The connecting protrusions 21 are disposed on top surfaces of the bodies 25 of the two supporting feet 24 two by two. The amount of the retaining protrusions 23 is four. The retaining protrusions 23 protrude out of bottom surfaces of the bodies 25 of the two supporting feet 24.

The carrier board 10 has multiple through holes 13. The through holes 13 are formed through the top surface of the carrier board 10 and are disposed adjacent to the two opposite side edges of the carrier board 10. Each one of the supporting feet 24 has at least one projection 26. The at least one projection 26 is formed on the top surface of the body 25 and is inserted into a respective one of the through holes 13.

Figure 9:
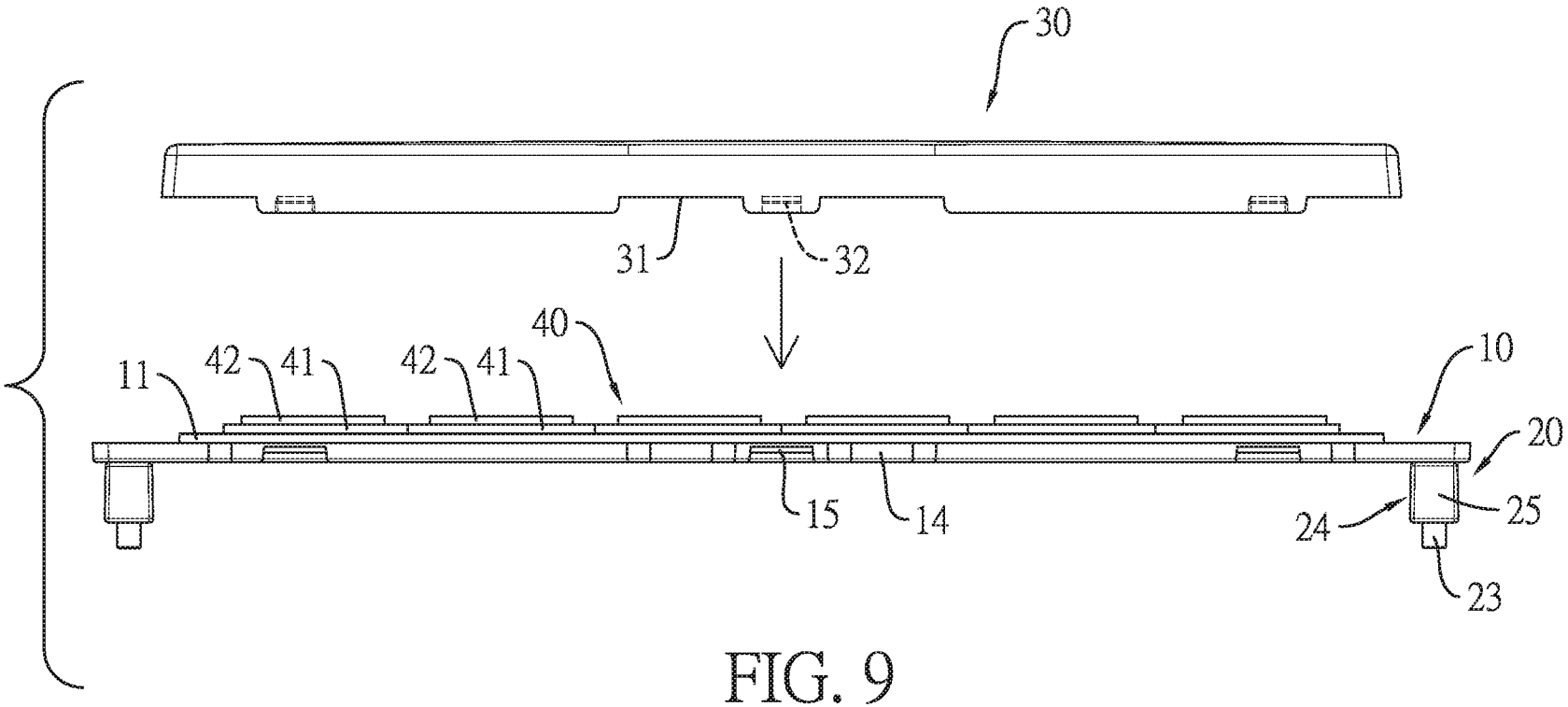
FIG. 9 is an exploded side view of a second embodiment of a pad supporting frame in accordance with the present invention.

With reference to FIG. 9, the carrier board 10 has two opposite side walls, four flanges 14, and two first engaging portions 15. An outer fringe of the carrier board 10 is composed of the two opposite side walls and the two opposite side edges of the carrier board 10. The four flanges 14 are formed on and laterally extend out of the two opposite side walls of the carrier board 10 two by two. The two first engaging portions 15 are formed on the two opposite side walls of the carrier board 10 and each first engaging portion 15 is located between respective two of the four flanges 14. The pad supporting frame has a cover 30. The cover 30 covers the carrier board 10. The cover 30 has two opposite side plates having two inner surfaces facing each other, four notches 31, and two second engaging portions 32. The four notches 31 are formed on and through the two inner surfaces of the two opposite side plates two by two. The four flanges 14 are respectively inserted into the four notches 31 and exposed out of the two opposite side plates of the cover 30. The two second engaging portions 32 are formed on the two inner surfaces of the two opposite side plates of the cover 30, are each located between respective two of the four notches 31, and engage with the two first engaging portions 15, respectively. In addition, a height of the body 25 of each one of the two supporting feet 24 is larger than a distance between a top surface of the cover 30 and the top surface of the carrier board 10.

Figure 4:
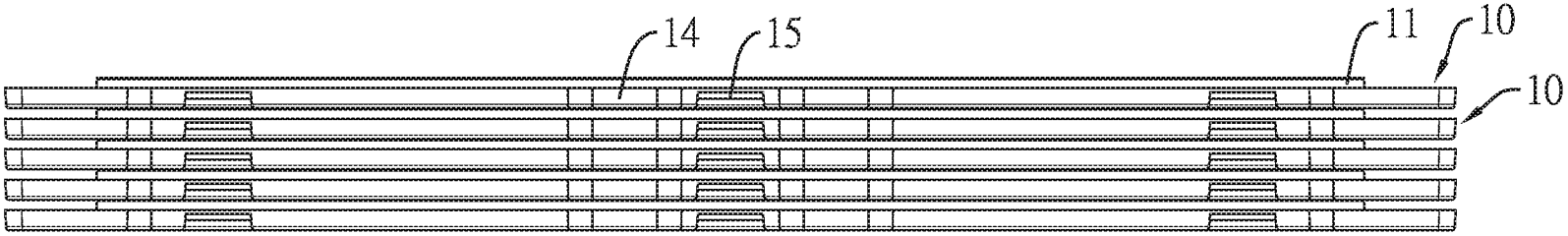
FIG. 4 is an operational side view of the pad supporting frame in FIG. 1, showing multiple carrier boards are stacked.
Figure 5:
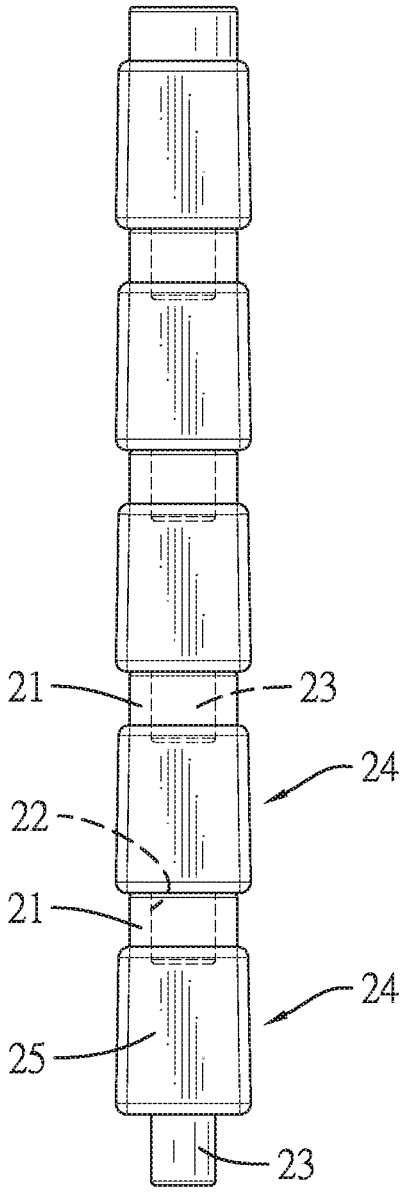
FIG. 5 is another operational side view of the pad supporting frame in FIG. 1, showing multiple supporting feet are stacked.

The supporting structure 20 is detachably disposed on the bottom surface of the carrier board 10. Molds for the carrier board 10 and the supporting structure 20 can be made separately. With reference to FIGS. 4 and 5, in delivery, multiple carrier boards 10 can be stacked. Multiple supporting structures 20 can be stacked, too. The carrier boards 10 and the supporting structures 20 are stacked separately for decreasing the delivery volume of the pad supporting frame and increasing the space utilization.

Figure 6:
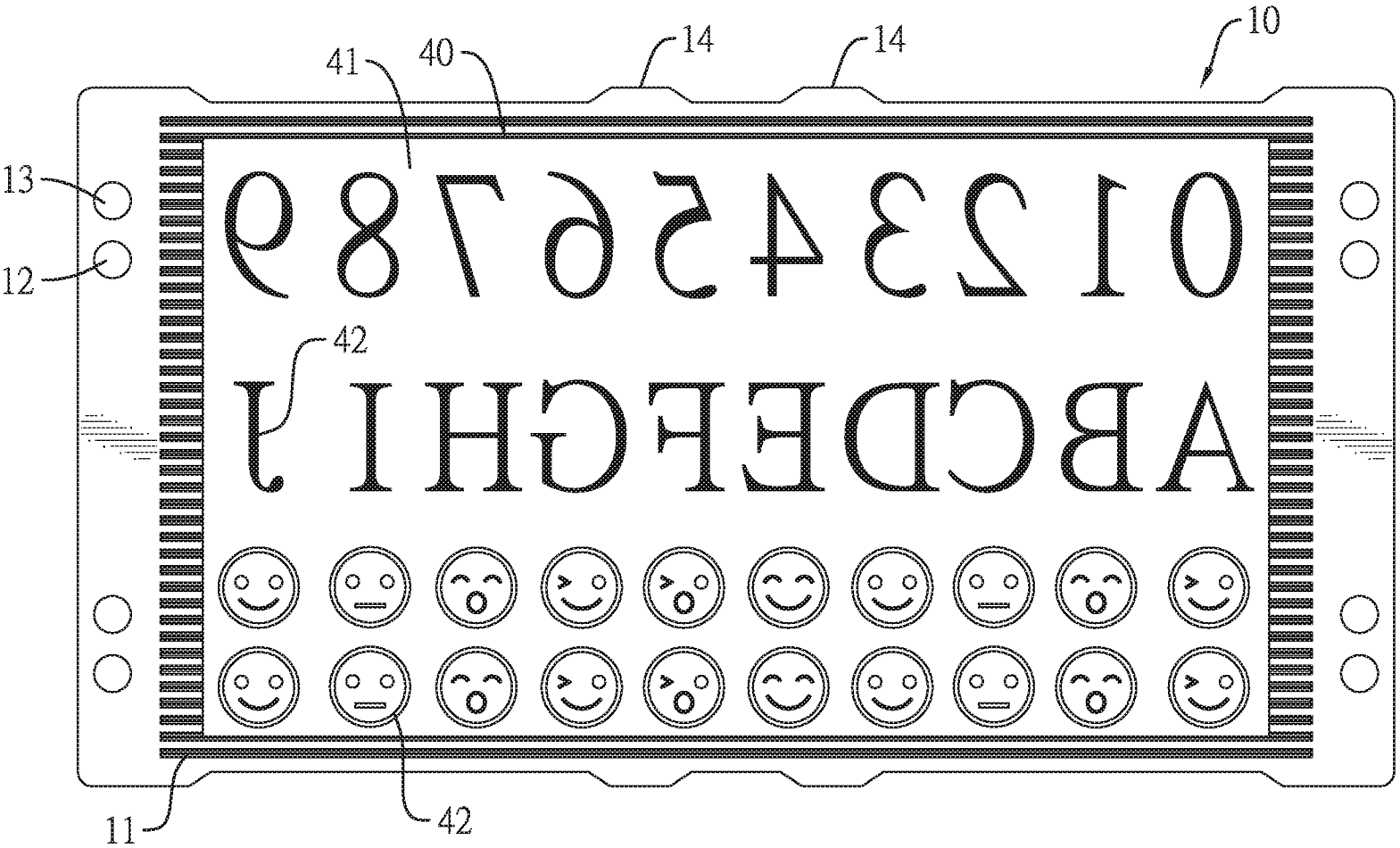
FIG. 6 is a top side view of the pad supporting frame in FIG. 1, showing an uncut pad is disposed on the carrier board.
Figure 7:
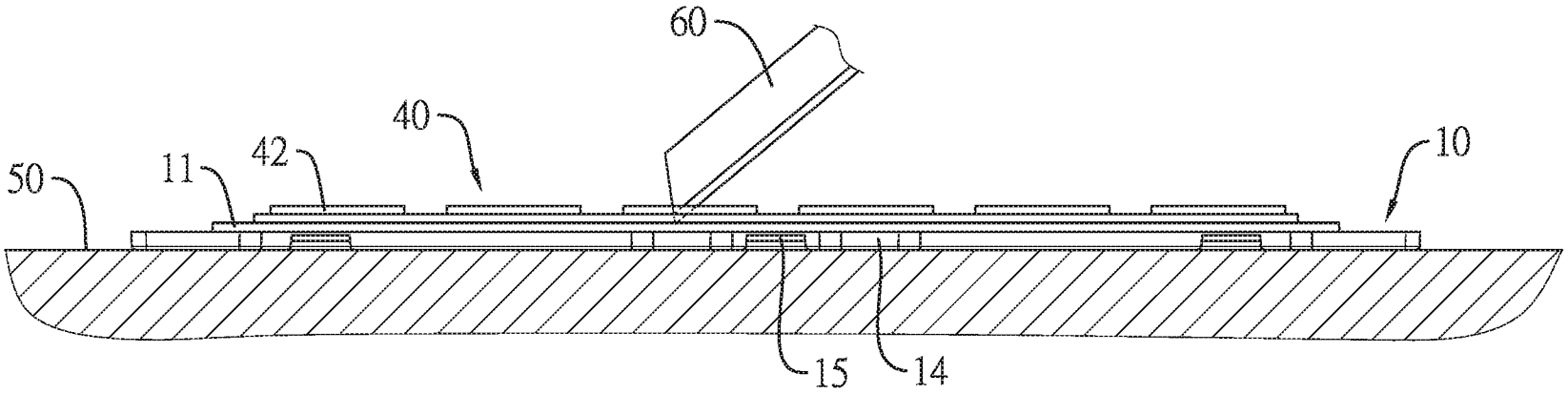
FIG. 7 is an operational side view of the pad supporting frame in FIG. 6, showing the pad is being cut by a cutting tool.
Figure 8:
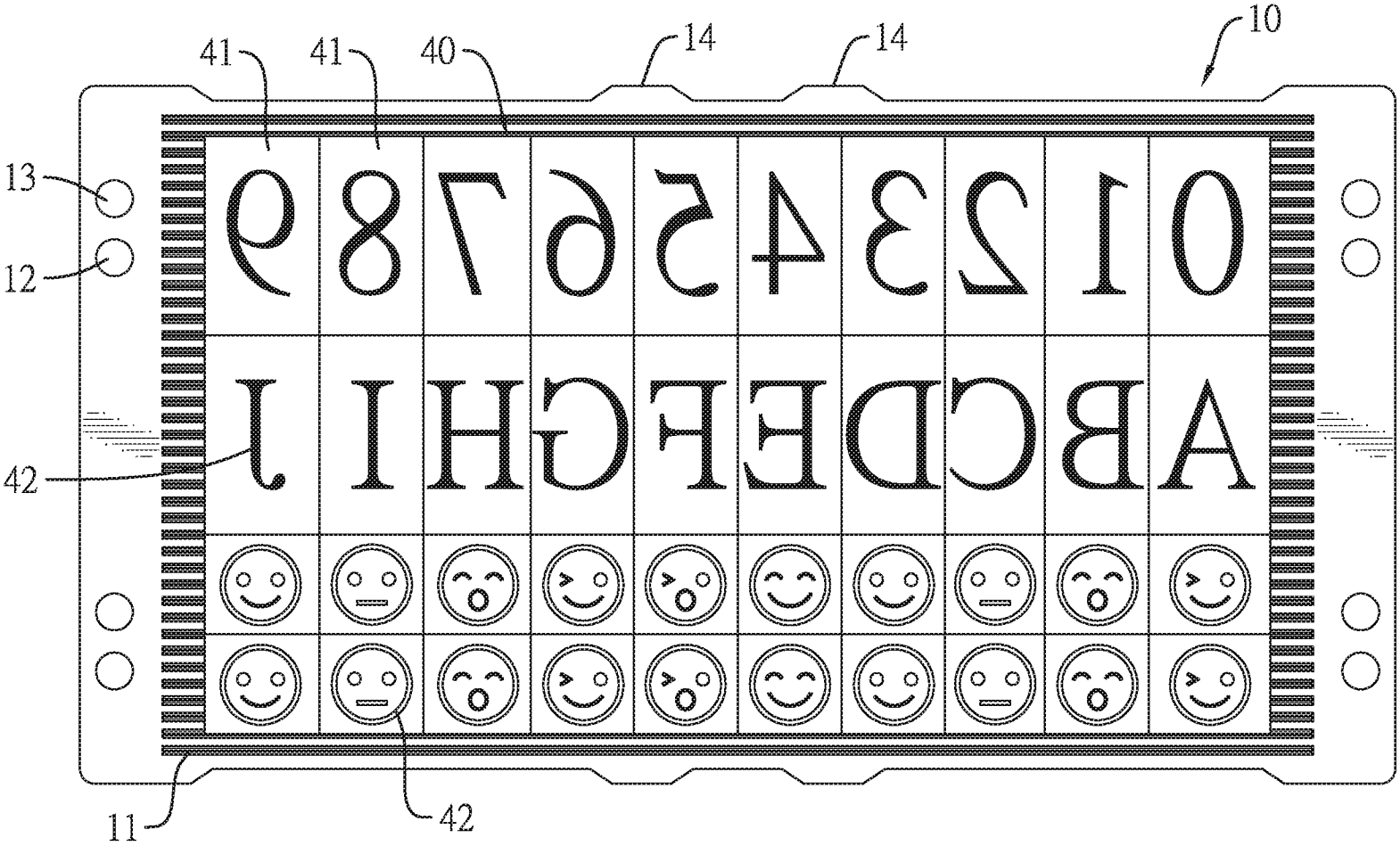
FIG. 8 is a top side view of the pad supporting frame in FIG. 6, showing the pad is cut already.

With reference to FIGS. 6 to 8, an uncut pad 40 is disposed on the carrier board 10. For cutting, the supporting structure 20 is detached from the carrier board 10. The carrier board 10 is directly disposed on a tabletop 50. The bottom surface of the carrier board 10 completely contacts the tabletop 50. A middle section of the carrier board 10 directly abuts against the tabletop 50. A cutting tool 60 cuts the pad 40 on the carrier board 10 and divides the pad 40 into multiple printing blocks 41. Cutting force applied by the cutting tool 60 is transmitted to the carrier board 10. The carrier board 10 supported by the tabletop 50 cannot be deformed. Each one of the printing blocks 41 is detachably disposed on the carrier board 10 and has at least one printing protrusion 42. The at least one printing protrusion 42 is disposed on a top surface of the corresponding printing block 41. The at least one printing protrusion 42 can show patterns or characters. By customization, the at least one printing protrusion 42 can be disposed on a printing seat of a stamp to be grouped into a printing pad.

Figure 10:
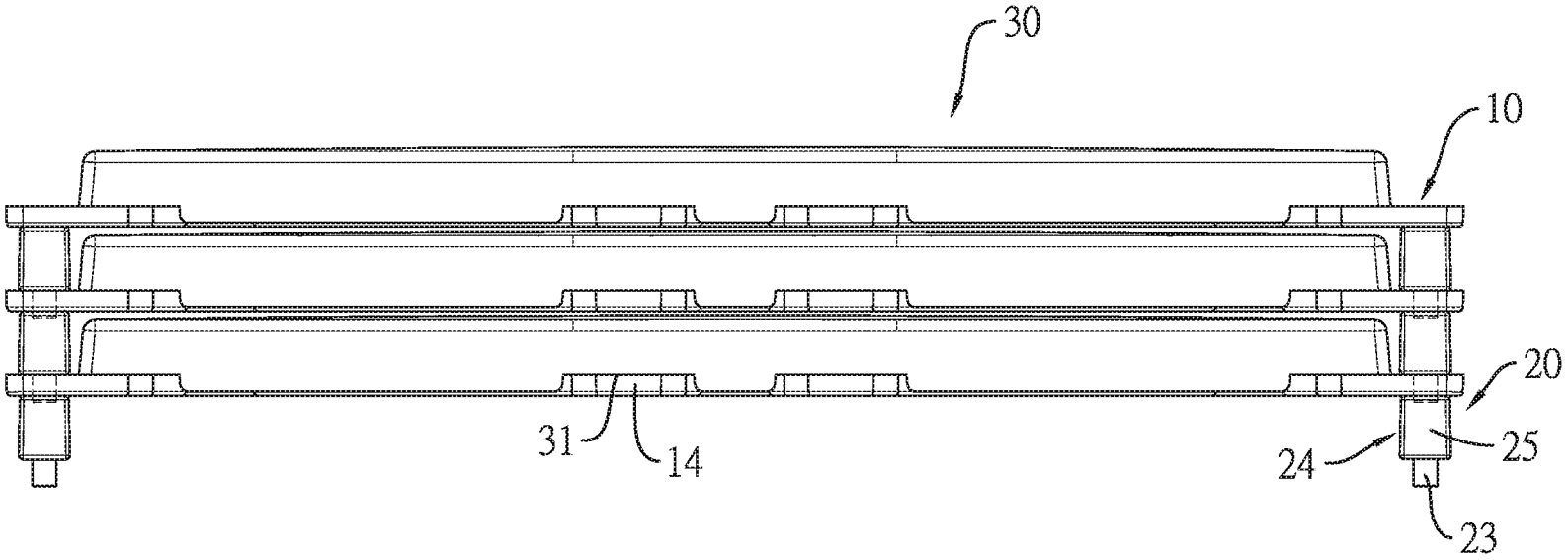
FIG. 10 is an operational side view of the pad supporting frame in FIG. 9, showing multiple carrier boards are stacked.
Figure 11:
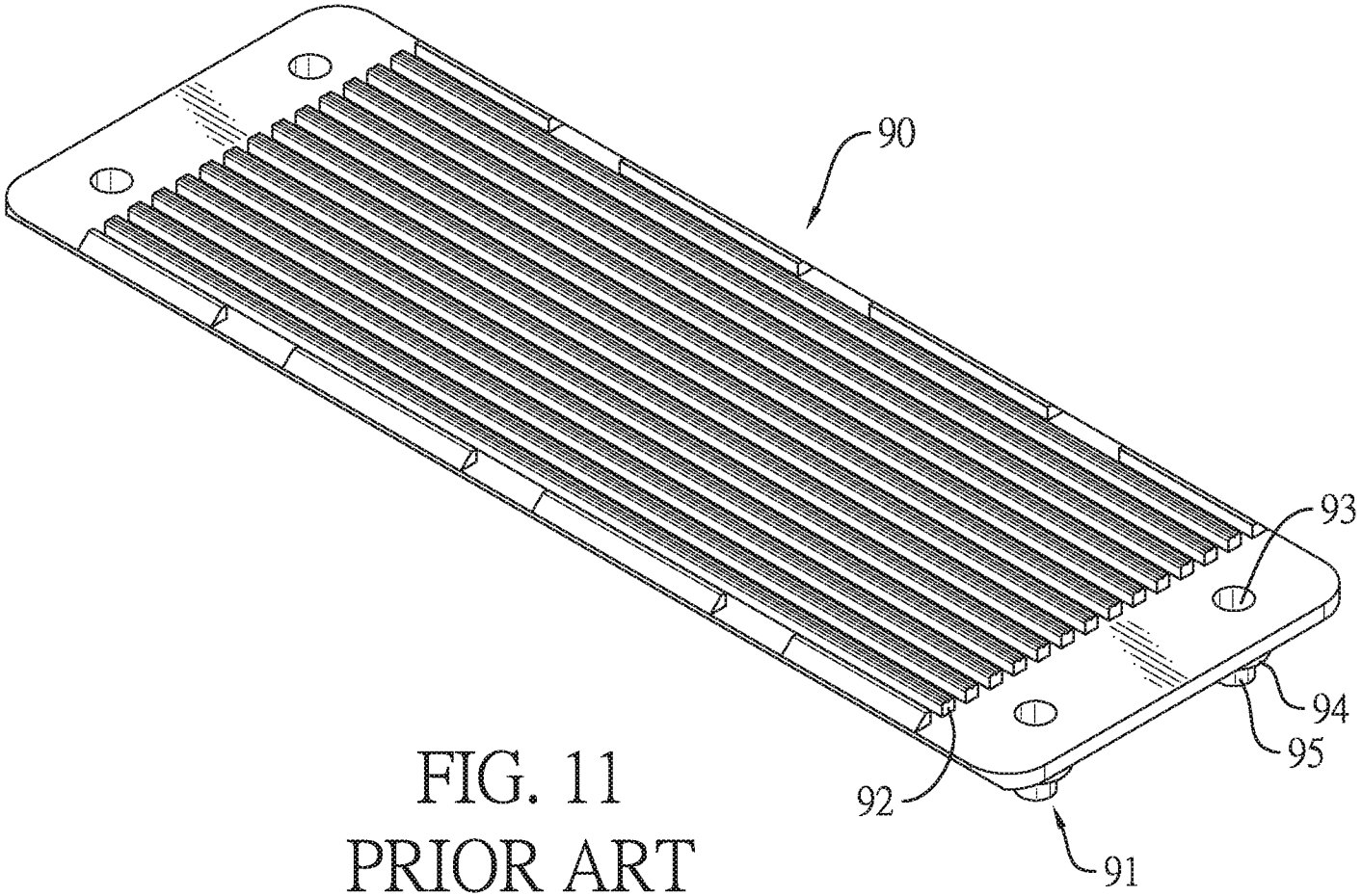
FIG. 11 PRIOR ART
FIG. 11 is a perspective view of a pad supporting frame in accordance with the prior art.
Figure 12:
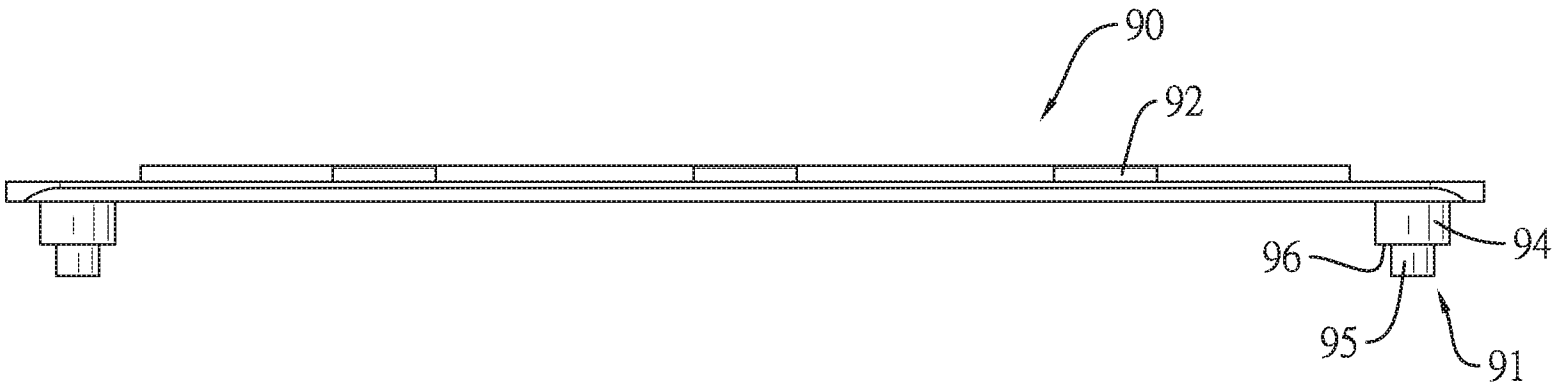
FIG. 12 PRIOR ART
FIG. 12 is a side view of the pad supporting frame in FIG. 11.
Figure 13:
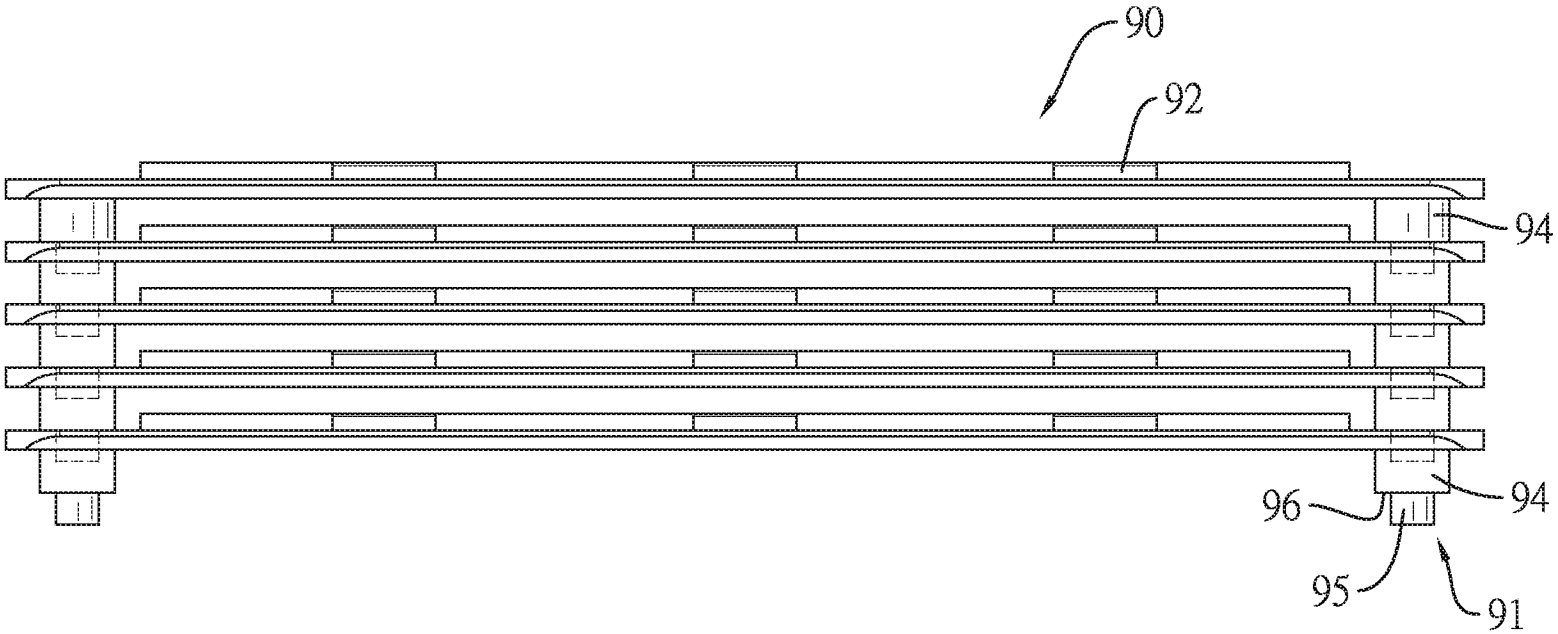
FIG. 13 PRIOR ART
FIG. 13 is an operational side view of the pad supporting frame in FIG. 11, showing multiple conventional pad supporting frames are stacked.
Figure 14:
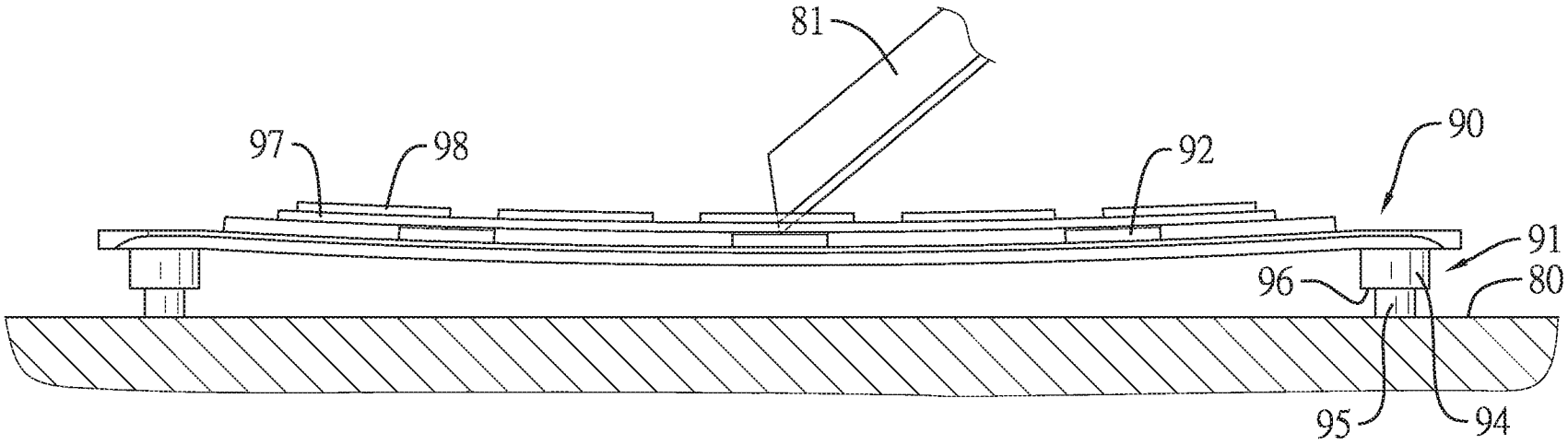
FIG. 14 PRIOR ART
FIG. 14 is another operational side view of the pad supporting frame in FIG. 11, showing a pad is disposed on the pad supporting frame and is cut by a cutting tool.
Figure 15:
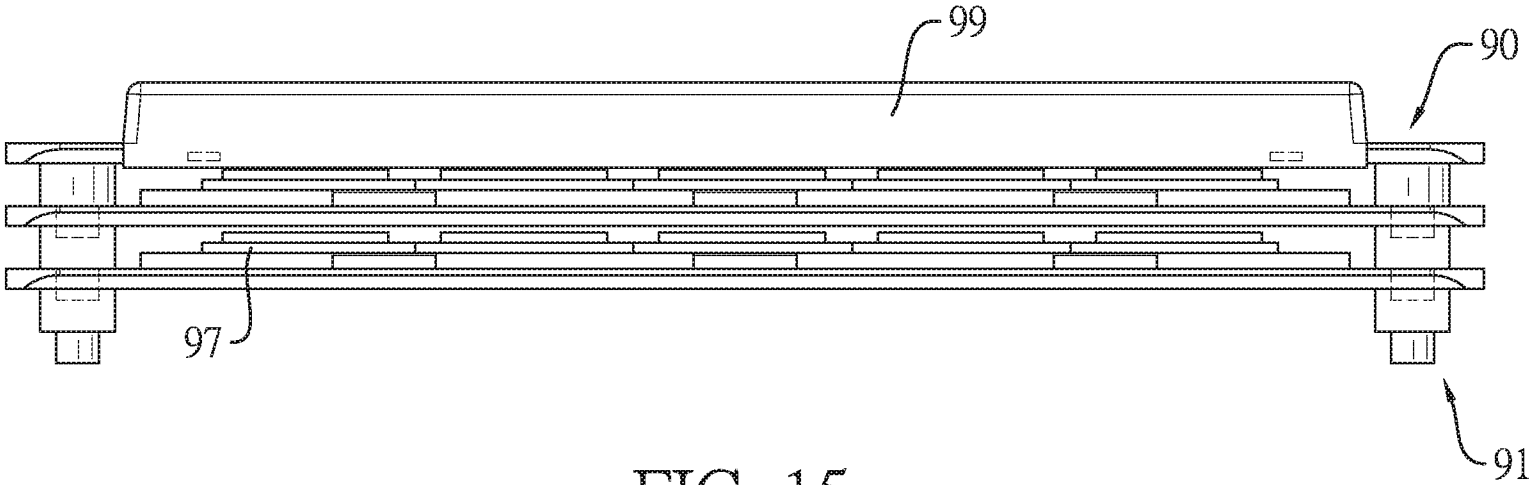
FIG. 15 PRIOR ART
FIG. 15 is another operational side view of the pad supporting frame in FIG. 11, showing a cover covers the conventional pad supporting frames stacked.

With reference to FIG. 10, when the cutting of the pad 40 is finished, the supporting structure 20 can be redisposed on the carrier board 10, and then the cover 30 covers the carrier board 10 for protecting the printing blocks 41 on the carrier board 10. With reference to FIGS. 1 and 10, multiple pad supporting frames covered by the covers 30 can be stacked. The retaining protrusions 23 of an upper pad supporting frame are respectively inserted into the retaining holes 22 of a lower pad supporting frame. The height of the body 25 of each one of the supporting feet 24 is larger than the distance between the top surface of the cover 30 and the top surface of the carrier board 10. After the pad supporting frames are covered by the covers 30, the pad supporting frames can be stacked and cannot be interfered by the covers 30. The printing blocks 41 on each one of the pad supporting frames are protected by the corresponding covers 30.

With reference to FIG. 10, when the cover 30 covers the carrier board 10, the second engaging portions 32 of the cover 30 respectively engage with the first engaging portions 15 of the carrier board 10, and the flanges 14 of the carrier board 10 are respectively inserted into the notches 31. For opening the cover 30, the flanges 14 of the carrier board 10 can be grabbed by one hand of a user, and the cover 30 can be grabbed by the other hand of the user and then is opened. The flanges 14 are easy to be grabbed by the user for opening the cover 30 conveniently.

Accordingly, the supporting structure 20 is detachably disposed on the carrier board 10. The carrier board 10 and the supporting structure 20 can be stacked separately for decreasing the delivery volume of the pad supporting frame and increasing the utilization of the delivery space. Molds for the carrier board 10 and the supporting structure 20 can be made separately for decreasing the volumes of the molds. The supporting structure 20 is detachably disposed on the carrier board 10. In the cutting operation of the pad 40, the carrier board 10 can be directly disposed on the tabletop 50. The cutting force is applied on the carrier board 10, the carrier board 10 will not be deformed, and the top surface of the carrier board 10 keeps flat for improving the cutting quality of the pad.

In addition, the height of the body 25 of each one of the supporting feet 24 is larger than the distance between the top surface of the cover 30 and the top surface of the carrier top 10. Thus, the pad supporting frames covered by the covers 30 can be stacked for increasing the fully-protective effect of the pad supporting frame. Furthermore, the flanges 14 of the carrier board 10 are inserted into the notches 31 of the cover 30 and exposed out of the two opposite side plates for increasing the opening convenience of the cover 30.

What is claimed is:

1. A pad supporting frame comprising:

a carrier board having a top surface;

a bottom surface;

two opposite side edges;

two opposite side walls, wherein an outer fringe of the carrier board is composed of the two opposite side walls and the two opposite side edges of the carrier board;

multiple bars formed on and protruding out of the top surface of the carrier board at spaced intervals;

multiple connecting holes formed through the top surface of the carrier board and the bottom surface of the carrier board;

four flanges formed on and laterally extending out of the two opposite side walls of the carrier board two by two; and two first engaging portions formed on the two opposite side walls of the carrier board, and each first engaging portion located between respective two of the four flanges;

a supporting structure detachably disposed on the carrier board, located on the bottom surface of the carrier board, and having multiple connecting protrusions respectively inserted into the connecting holes;

multiple retaining holes formed on top surfaces of the connecting protrusions respectively; and multiple retaining protrusions formed on bottom surfaces of the connecting protrusions respectively, wherein an outer diameter of each one of the retaining holes is smaller than an outer diameter of a corresponding one of the connecting protrusions; and a cover covering the carrier board and having two opposite side plates having two inner surfaces;

four notches formed on and through the two inner surfaces of the two opposite side plates two by two, wherein the four flanges are respectively inserted into the four notches; and two second engaging portions formed on the two inner surfaces of the two opposite side plates, each second engaging portion located between respective two of the four notches, and the two second engaging portions engaging with the two first engaging portions.

2. The pad supporting frame as claimed in claim 1, wherein the connecting protrusions are disposed adjacent to the two opposite side edges of the carrier board;

the supporting structure has two supporting feet detachably disposed on the bottom surface of the carrier board at a spaced interval, and respectively located adjacent to the two opposite side edges of the carrier board, and each one of the two supporting feet having a body, wherein the connecting protrusions are respectively disposed on the bodies of the two supporting feet.

3. The pad supporting frame as claimed in claim 2, wherein a height of the body of each one of the two supporting feet is larger than a distance between a top surface of the cover and the top surface of the carrier board.

4. The pad supporting frame as claimed in claim 2, wherein the two supporting feet are elongate components, the amount of the connecting protrusions is four, the connecting protrusions are disposed on top surfaces of the bodies of the two supporting feet two by two, the amount of the retaining protrusions is four, and the retaining protrusions protrude out of bottom surfaces of the two supporting feet.

5. The pad supporting frame as claimed in claim 4 wherein a height of the body of each one of the two supporting feet is larger than a distance between a top surface of the cover and the top surface of the carrier board.

6. The pad supporting frame as claimed in claim 4, wherein the carrier board has multiple through holes, the through holes are formed through the top surface of the carrier board and are disposed adjacent to the two opposite side edges of the carrier board, each one of the supporting feet has at least one projection, and the at least one projection is formed on the top surface of the body and is inserted into a respective one of the through holes.

7. The pad supporting frame as claimed in claim 6, wherein a height of the body of each one of the two supporting feet is larger than a distance between a top surface of the cover and the top surface of the carrier board.

* * * * *